US007004075B2

(12) United States Patent
Ronn et al.

(10) Patent No.: US 7,004,075 B2
(45) **Date of Patent: *Feb. 28, 2006**

(54) DEVICE WITH SELECTABLE UNITS THAT ARE FIRED OR LAUNCHED

(75) Inventors: Torsten Ronn, Karlskoga (SE); Jan Fixell, Karlskoga (SE)

(73) Assignee: Bofors Defence AB, Karlskoga (SE)

( * ) Notice: Subject to any disclaimer, the term of this patent is extended or adjusted under 35 U.S.C. 154(b) by 0 days.

This patent is subject to a terminal disclaimer.

(21) Appl. No.: 10/312,887

(22) PCT Filed: Jun. 20, 2001

(86) PCT No.: PCT/SE01/01405

§ 371 (c)(1),
(2), (4) Date: Mar. 27, 2003

(87) PCT Pub. No.: WO02/03008

PCT Pub. Date: Jan. 10, 2002

(65) Prior Publication Data

US 2003/0164108 A1 Sep. 4, 2003

(30) Foreign Application Priority Data

Jul. 3, 2000 (SE) ..... 0002490

(51) Int. Cl.
*F42B 12/32* (2006.01)

(52) U.S. Cl. ..... 102/473; 102/795

(58) Field of Classification Search ..... 102/473, 102/491, 492, 494, 495; F42B 12/32
See application file for complete search history.

(56) References Cited

U.S. PATENT DOCUMENTS

| | | | | |
|---|---|---|---|---|
| 3,980,019 A | | 9/1976 | Anderson et al. | |
| 4,030,421 A | | 6/1977 | Litman | |
| 4,494,459 A | | 1/1985 | Ziemba | |
| 4,524,696 A | * | 6/1985 | Altenau et al. | 102/491 |
| 5,038,686 A | * | 8/1991 | Zulkoski et al. | 102/496 |
| 5,119,730 A | * | 6/1992 | Garnett et al. | 102/496 |
| 5,691,502 A | * | 11/1997 | Craddock et al. | 102/494 |
| 5,979,332 A | * | 11/1999 | Hammer et al. | 102/496 |

* cited by examiner

*Primary Examiner*—Teri Pham Luu
*Assistant Examiner*—Susan C Alimenti
(74) *Attorney, Agent, or Firm*—Connolly Bove Lodge & Hutz LLP; Larry J. Hume

(57) ABSTRACT

An ammunition unit, such as a missile, the casing of which contains at least one explosive charge as well as warhead modules arranged in or on the fuselage or casing that comprise a constituent part of the unit's warhead function when the explosive charge is actuated. The warhead effect modules are of modular design, and the various modules are secured to the fuselage or casing by securing devices and/or retention parts. The device includes a range of modules pertaining to different types of warhead effects. When engaging an actual type of target the ammunition unit is assembled with an array of modules-selected from the range of modules-matched to different types of targets or engagement situations, with the array of modules secured to the fuselage or casing by securing devices.

17 Claims, 6 Drawing Sheets

Figure 1:
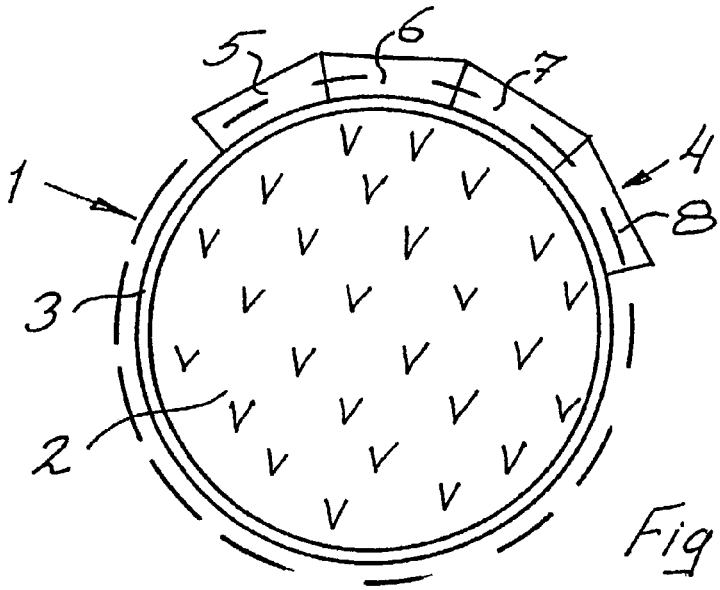

106
17'
107
2'

106
18'
107
2'

106
19'
107

106
108
2'
1'

DEVICE WITH SELECTABLE UNITS THAT ARE FIRED OR LAUNCHED

The present invention relates to a device for a launchable ammunition unit such as a missile or artillery shell. The fuselage or casing of the device comprises at least one explosive charge, and inside or on the fuselage or casing there are warhead effect modules that implement or are a constituent part of the warhead function when the explosive charge is actuated.

The use of ammunition units, such as missiles and artillery shells, for different types of warhead effects—operating with fragmentation, pellets, shaped charge effect and blast generating or fragmentation inhibiting agents, for example—is already known. Reference can thereby be made to a large number of patents and patent applications in this particular field. Missiles, shells or equivalent can thus comprise an explosive charge or charges and different warhead effect jackets and warhead devices which, when the explosive is detonated, produce fragmentation, incendiary agents, shaped charge effect, etc, which are actuated against the actual target when the explosive charge is triggered. Each missile or equivalent is equipped with and/or interacts with a target seeker and guidance system of various types during the actual engagement.

In the context of new weapon systems and types of ammunition there is a distinct need to be able to reduce the multiplicity of types of weapons. Consequently, there exists a desire that the reductions shall be possible without the techniques and handling around the weapon system becoming more complex. It is vital that the launch and engagement functions can remain optimised for the type of target in question, and that rapid, precise functions can be maintained in conjunction with actual target engagements and scenarios despite the said reductions. It is also important that a high level of service can be maintained, and that all requirements can be met within the financial constraints stipulated. It is also vital that the requirement for a high degree of safety be maintained.

The main objective of the present invention is to resolve these problems completely or partially.

The present invention exploits, among other things, the insight that efforts shall be focused on the most critical components—from a technical aspect—in current systems and that inroads and modifications, for example, shall not be necessary in complex units such as target seekers, guidance systems, etc.

As claimed in the present invention a significant reduction in the assortment of types of ammunition and warhead devices shall be enabled by using a modular approach to warhead function devices that basically represents a well proven and technically feasible technique which—from a cost aspect, for example—represents a relatively small value (e.g. 1–5%) of the total cost of the system (missile) as such.

The most characteristic features of the device as claimed in the present invention are, among other things, that the warheads have a modular design and that the various warhead modules are secured by securing devices or parts in or attached to the fuselage or casing. Other characteristics are that the device incorporates a range of warhead effect modules pertaining to different types of warhead and that the ammunition unit in question, when engaging a specific type of target or engagement situation, is comprised of a modular array selected from the range of warhead effect modules matched to different types of targets or engagement situations and secured to the fuselage or casing by securing devices or retention parts.

In design variants of the invention concept the ammunition unit can comprise warhead effect jackets arranged on the outside of the fuselage or casing, and consisting of a module array selected from the range of modules. The said design variants utilise modules with large pellets, small pellets, pre-fragmentation, incendiary elements, carbon fibre elements, fragmentation inhibiting and blast generating agents, etc. The range of modules also includes modules comprising shaped charges. Modules comprising agents that inhibit warhead effect in a specific direction are also included.

In another design variant one or more types of module can comprise explosive charge modules that are actuatable via an initiation function when one or more separation charges in the ammunition unit are initiated or actuated. In a preferred design variant the warhead device comprises a package unit in which the ammunition unit, such as a missile or shell, with associated explosive and/or separation charge(s) as well as a number of warhead effect modules are packed. The components incorporated in the package unit enable the configuration of an ammunition unit that is optimised for each specific type of target or engagement situation.

The above proposals enable major financial benefits by virtue of the fact that the number of different ammunition units or missiles or shells can be reduced. This reduction can be achieved without any degradation of safety aspects or effectiveness during an engagement. Another advantage with the proposed system or device is that a high degree of optimisation of the ammunition unit for the type of target or equivalent can be performed on site. Assembly of the various ammunition units on site requires no special knowledge, and use of the new types of ammunition can be realised by conventional training and learning.

Figure 2:
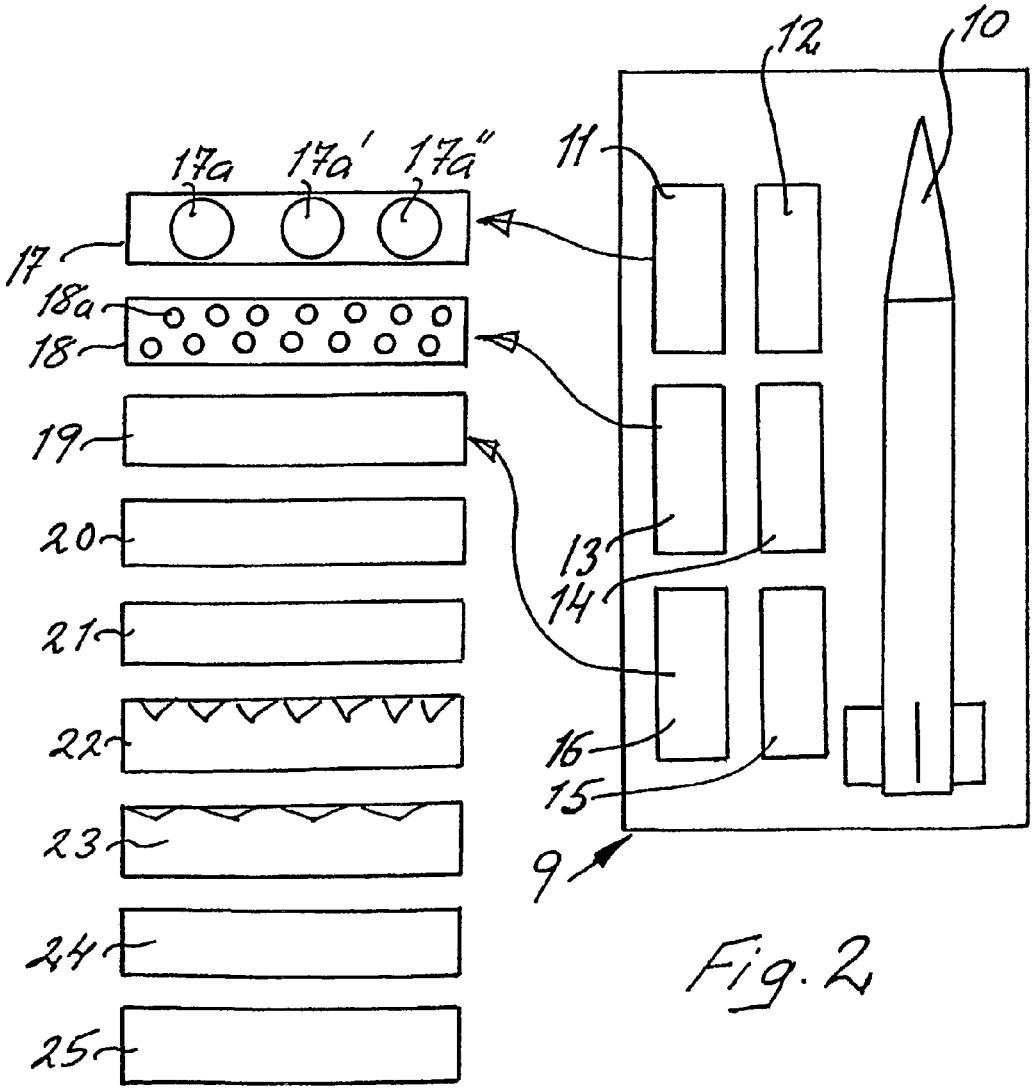
Figure 3:
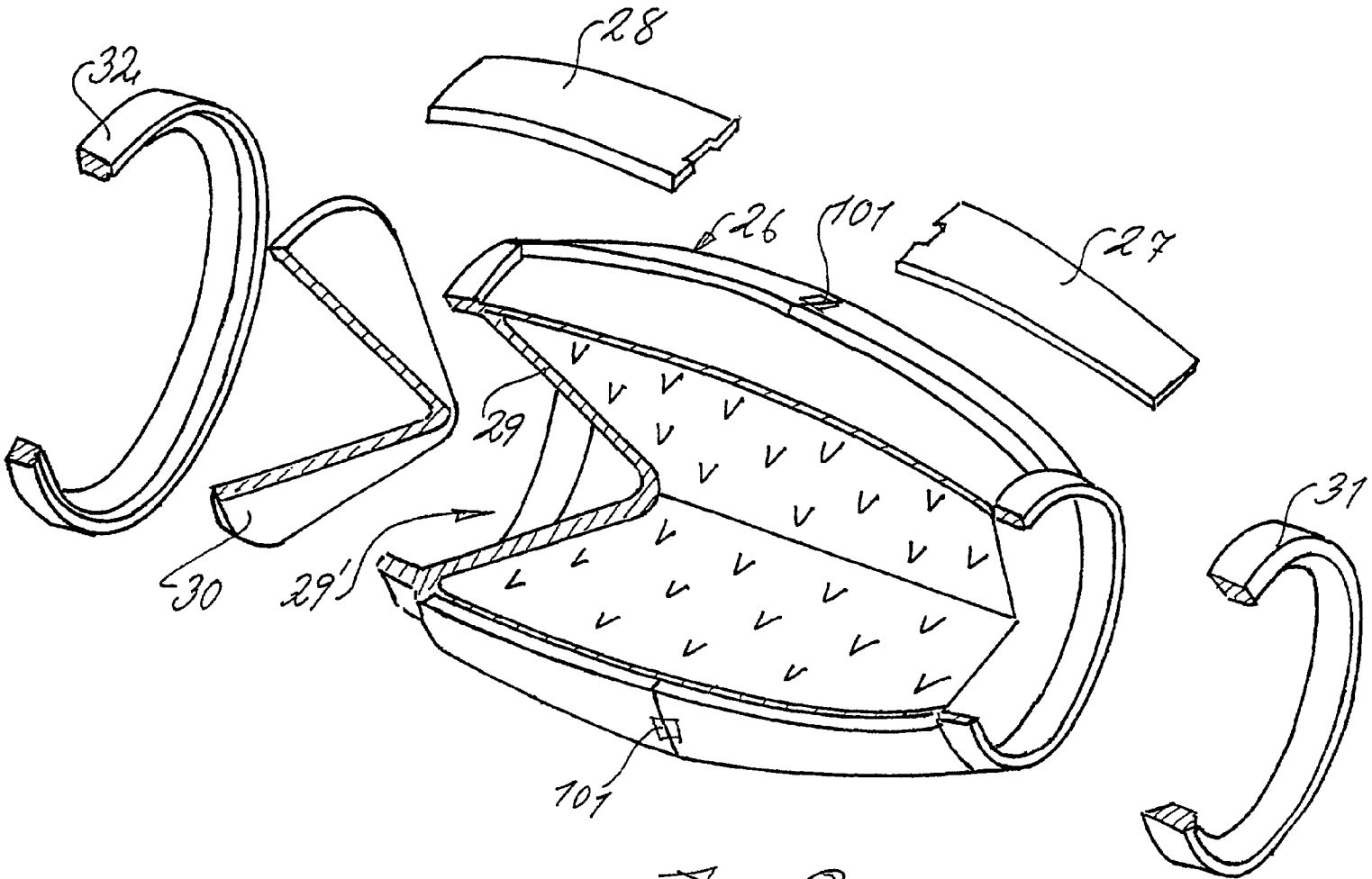
Figure 4:
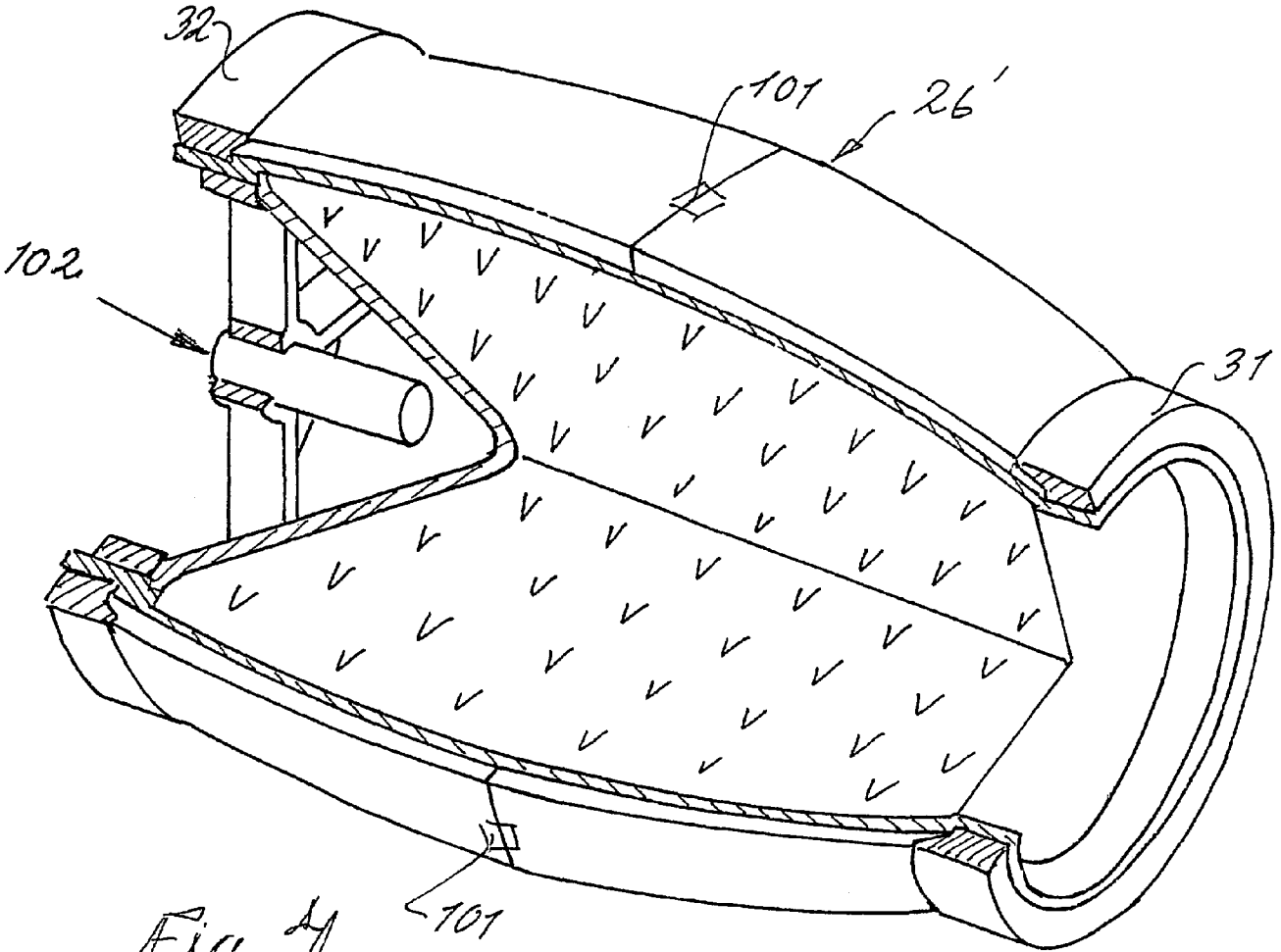
Figure 5:
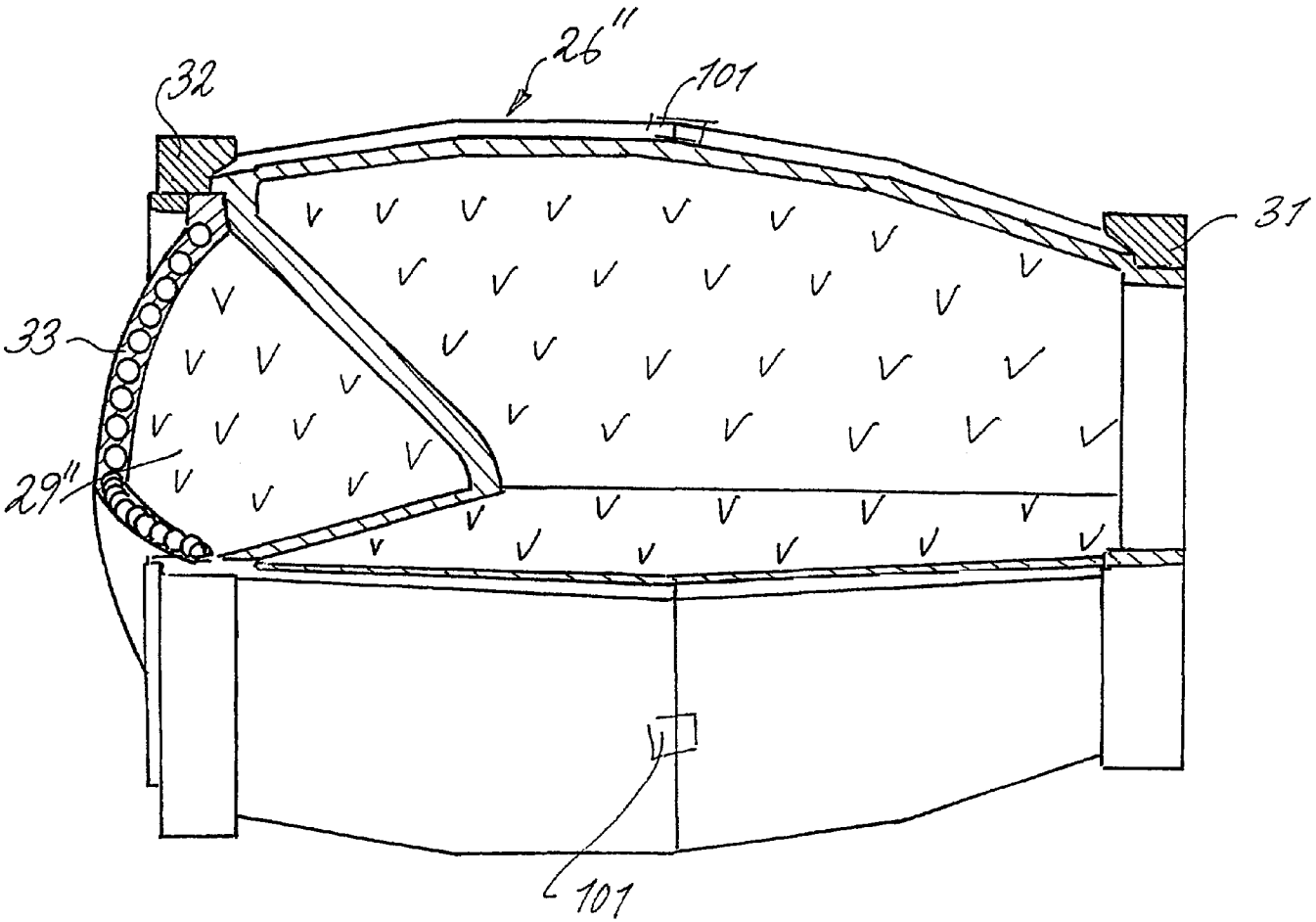
Figure 6:
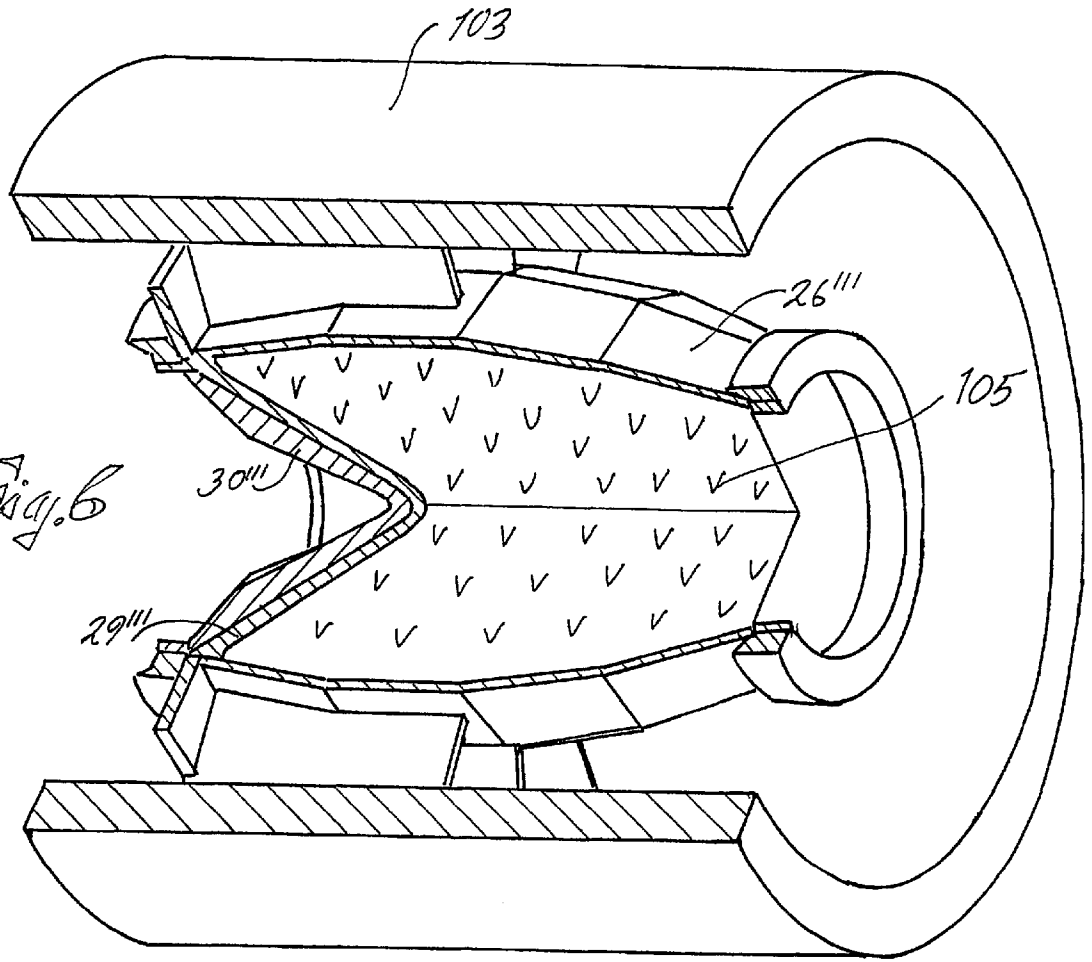
Figures 7, 7A, 7B, 7C:
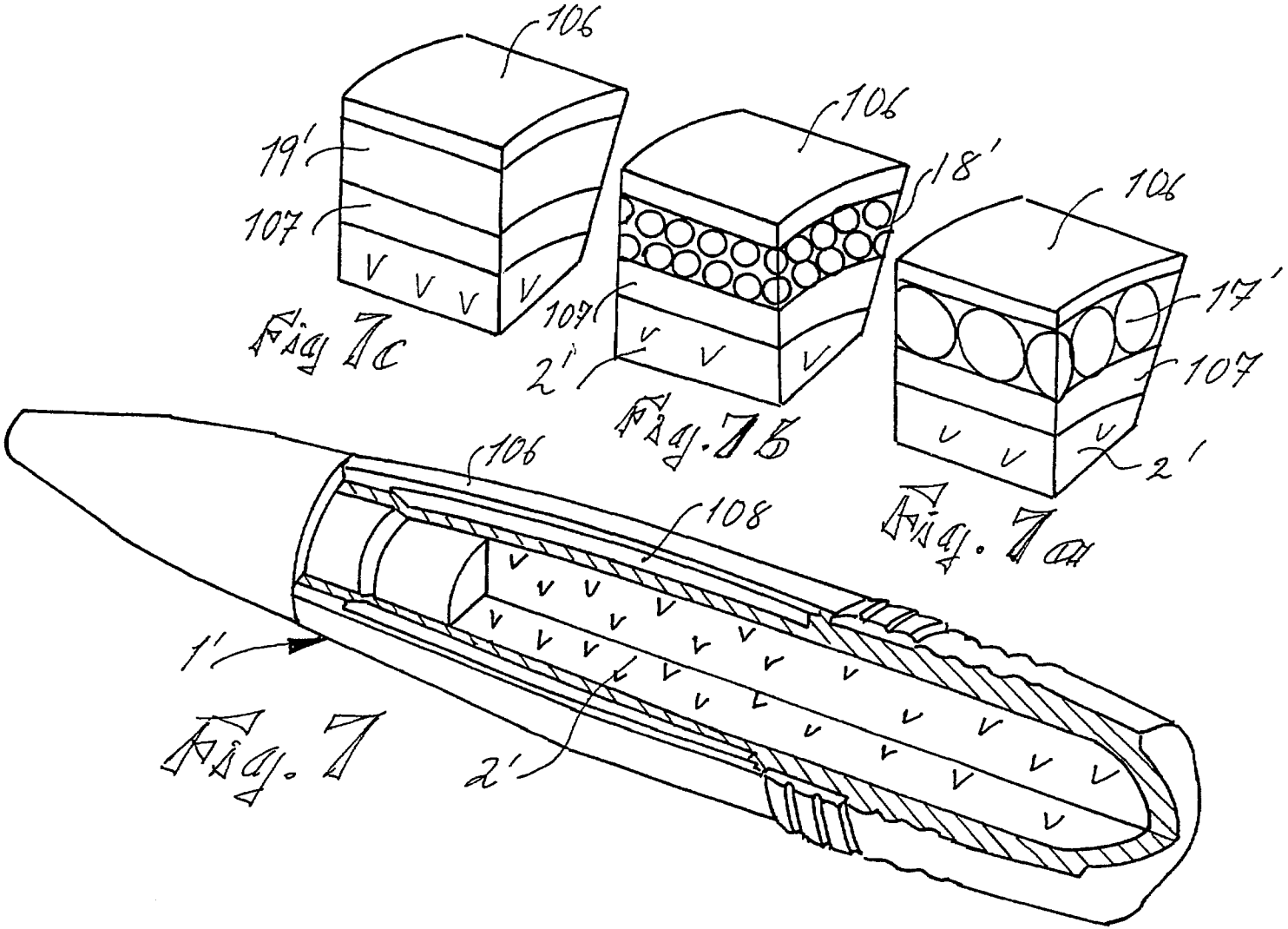

Some of the currently proposed design variants for various devices displaying characteristics that are significant for the present invention are described below with reference to the appended FIGS. 1–7 in which FIG. 1 shows a general cross-section of a missile partially illustrating its explosive charge and parts of a warhead effect jacket consisting of modules, FIG. 2 shows a general diagram of a package unit with different types of modules and an ammunition unit in the form of a symbolically designated missile, FIG. 3 shows an exploded diagram in perspective viewed obliquely from above and behind of a warhead device to which the modules are attachable, FIG. 4 shows an exploded diagram in perspective viewed from above and behind of a warhead device with a shaped charge module of a first type, while FIG. 5 shows a section viewed from the side illustrating, among other things, a shaped charge module of a second type, whereas FIG. 6 shows another shaped charge module with an increment module of a special type, and finally FIG. 7 shows an exploded diagram in perspective viewed from above and behind of an artillery shell comprised of modules.

FIG. 1 shows a missile (or other unit of ammunition) designated 1. The missile can be of an already known type containing an explosive charge 2 located in a casing generally designated 3. The casing is fitted with a warhead effect jacket 4 consisting of a number of modules of which four modules 5, 6, 7, 8 are illustrated. The warhead effect jacket extends around the entire casing 3, which completely encloses the explosive charge 2.

FIG. 2 shows a package unit designated 9. The package unit can comprise a missile 10 with an explosive charge inside (cf. 2 in the above). The missile can be of an already known type and, consequently, will not be described in any further detail herein. The package unit 9 also comprises cassettes 11, 12, 13, 14, 15 and 16. Each cassette is charged with modules as per the above. Cassettes 11–16 thereby contain modules pertaining to different types of warhead. Thus cassette 11 in the design example incorporates modules 17 containing pellets of large dimension of which three pellets 17*a*, 17*a*' and 17*a*" are illustrated in FIG. 2. Cassette 13 incorporates modules 18 containing pellets of small dimension designated 18*a*. Furthermore, cassette 16 contains modules 19 with fragmentation inhibiting agent. Cassettes 12, 14, 15 can incorporate modules 20 containing incendiary elements, modules 21 containing carbon fibre elements, and modules 22 and 23 containing different shaped charge modules. Additional modules can occur and are thereby represented by module 24 in FIG. 2. Warhead effect inhibiting modules can also be included. These are designated 25 in FIG. 2. Effect inhibiting modules are used to constrain the effect in a specific direction, such as radially. This could be to avoid damage to objects near the target that one wishes to leave intact. In FIG. 2 the number of cassettes differs from the number of modules illustrated. The same cassette can contain different types of modules and, similarly, the number of cassettes can be varied so that, for example, two cassettes can contain the same type of module, and so on.

Depending on the type of target or engagement situation, missile 10 or equivalent can be equipped with a warhead effect jacket or warhead effect modules as described above. Modules 5–8 in FIG. 1 can thus alternatively consist of modules of types 17, 18, 19, 20, etc, or possibly a combination of the said modules.

FIG. 3 shows a warhead casing designated 26. The outside of the casing can thereby be designed as a rotating body, or with a continuous outer surface in the form of a number of flat facets on which flat warhead effect modules can be attached whereby each such module bears against one or more facets. This latter design is especially suited to mechanical mass production, and its specific design has not been shown to entail any negative effect whatsoever on the function of the assembled warhead.

The casing can also be fitted with panels 27, 28 that are removable and can be replaced by specific warhead effect modules as per the above. The casing 26 is also equipped with a fixed, shaped charge liner 29 that leaves an unobstructed cavity 29' facing forwards in the intended direction of warhead effect. An effect enhancing liner 30 can be applied in this cavity. Such an effect enhancing liner can, for example, be added to provide an otherwise conventional shaped charge liner with a behind armour effect function that is considered to offset the reduced penetration in the target that such an increase in the original thickness of a liner inevitably causes. Panels 27, 28 or alternatively applied modules (cf. 17–25 as per the above) are locked on the outside of the casing by the end-mounted securing devices 31 and 32 when they have been installed in their designated locations, and by additional securing devices 101 applied along the edges of the modules that are not in direct contact with securing devices 31 or 32.

FIG. 4 shows principally the same warhead as that illustrated in FIG. 3, but in FIG. 4 the warhead is designated 26'. However, warhead 26' has been furnished with a cruciform, removable front insert 102 whose task is to de-energise the shaped charge jet in the event of hazard initiation or when a shaped charge function is not desirable.

In FIG. 5 the securing devices 31, 32 and 101 are shown installed on the warhead 26". Moreover, warhead 26" has been supplemented in front of the shaped charge liner with a fragmentation jacket 33 containing heavy metal pellets. In addition, the space between the fragmentation jacket 33 and the fixed shaped charge liner 29 has been filled with an appropriate explosive charge 29". With these additions the original shaped charge warhead has been converted to a fragmentation warhead.

FIG. 6 shows yet another alternative for modifying a shaped charge in a warhead. The shaped charge and casing 26'" illustrated in the Figure can, for example, be incorporated in a precision guided missile with which one desires effect in the target solely in the direction of impact. This may, for example, apply if sensitive civil objects that one does not wish to damage are in the immediate vicinity of the target. The shaped charge and its casing 26'" is surrounded by a tubular shield 103 that may, for example, consist of carbon fibre reinforced polyester mixed with an appropriate aggregate material such as heavy alloy powder. The task of the shield 103 is to completely eliminate all radial warhead effect. In other respects the shaped charge is of the same type as the one in FIG. 3, with an explosive charge 105 and an inner liner 29'" and an outer liner 30'".

FIG. 7 shows an anti-aircraft shell 1' with an explosive charge 2' under whose removable outer casing 106 warhead effect modules of types 17', 18' and 19' can be installed in a space 108, after which the outer casing 106 can be re-fitted prior to firing.

FIGS. 7*a*–7*c* show partial sections through a part of the shell after various warhead effect modules have been installed. FIG. 7*a* thus illustrates a fragmentation module with large heavy metal pellets 17'. Each partial section also includes parts of the outer casing 106, the inner casing 107 and the explosive charge 2'. FIG. 7*b* illustrates a similar fragmentation module with small pellets 18', and FIG. 7*c* illustrates a warhead effect module containing an incendiary or blast generating agent 19'.

The present invention is not limited to the design examples described above, but can be subjected to modifications within the framework of the subsequent Patent claims and the invention concept.

We claim:

1. An ammunition unit, comprising:

a casing;

an explosive charge in the casing;

a plurality of exchangeable warhead modules disposable on or in the casing, wherein the warhead modules are selectable from a range of warhead unit types; and securing devices or retention parts for securing the warhead modules to or in the casing, wherein the modules comprise at least two modules of differing type selected from the group consisting of:

modules comprising pellets of large dimension; modules comprising pellets of small dimension; modules comprising fragmentation inhibiting agents; modules comprising incendiary agents; modules comprising carbon fiber elements; modules comprising blast-generating agents; and modules comprising shaped charges.

2. The ammunition unit of claim 1, wherein the plurality of warhead modules comprises:

a warhead effect jacket or warhead effect modules disposed on the outside of the casing.

3. The ammunition unit of claim 1, comprising:

jacket modules or at least one panel for modules.

4. The ammunition unit of claim 1, wherein one or more modules comprise explosive charges that are actuated when one or more shaped charges of the ammunition unit are initiated, the explosive charges being different from the one or more shaped charges.

5. The ammunition unit of claim 1, wherein the securing devices comprise:

one or more collar shaped elements ranged to removably secure one or more modules on the casing.

6. The ammunition unit of claim 1, wherein the ammunition unit is an artillery shell and comprises a removable outer casing, wherein a space exists beneath the casing for housing warhead effect elements.

7. The ammunition unit of claim 1, wherein at least some of the modules are packed in package units, each package unit containing:

an ammunition unit having an explosive or shaped charge; and modules for matching the ammunition to a specific target or engagement situation.

8. The ammunition unit of claim 1, wherein the modules comprise at least three modules of differing type selected from the group.

9. The ammunition unit of claim 1, wherein the modules comprise at least four modules of differing type selected from the group.

10. The ammunition unit of claim 1, comprising:

an outer casing surrounding the modules.

11. The ammunition unit of claim 1, wherein the modules are arranged in cassettes, a plurality of modules being present in each cassette.

12. A package unit, comprising:

an ammunition unit according to claim 1;

a plurality of cassettes, the cassettes comprising at least two modules of differing type selected from the group consisting of: modules comprising pellets of large dimension; modules comprising pellets of small dimension; modules comprising fragmentation inhibiting agents; modules comprising incendiary agents; modules comprising carbon fiber elements; modules comprising fragmentation inhibiting agents; modules comprising blast-generating agents; and modules comprising shaped charges.

13. The package unit of claim 12, wherein the modules comprise at least three modules of differing type selected from the group.

14. The package unit of claim 12, wherein the modules comprise at least four modules of differing type selected from the group.

15. The package unit of claim 12, wherein the plurality of warhead modules comprises:

a warhead effect jacket or warhead effect modules disposed on the outside of the casing.

16. The package unit of claim 12,comprising:

jacket modules or at least one panel for modules.

17. The package unit of claim 12, wherein one or more modules are actuated when one or more shaped charges of the missile are initiated.

* * * * *